US005490699A

United States Patent [19]

Uyeda

[11] Patent Number: 5,490,699

[45] Date of Patent: Feb. 13, 1996

[54] ELECTRIC STRIKE FOR FAIL SAFE OR FAIL SECURE OPERATION

[75] Inventor: Alan K. Uyeda, Pico Rivera, Calif.

[73] Assignee: Adams Rite Manufacturing Company, Industry, Calif.

[21] Appl. No.: 236,047

[22] Filed: May 2, 1994

Related U.S. Application Data

[63] Continuation of Ser. No. 93,473, Jul. 19, 1993, abandoned.

[51] Int. Cl.[6] ..... E05B 15/02

[52] U.S. Cl. ..... 292/341.16; 292/201; 292/DIG. 65

[58] Field of Search ..... 292/144, 201, 292/244, 334.3, 341.16, DIG. 60, DIG. 65

[56] References Cited

U.S. PATENT DOCUMENTS

| | | | |
|---|---|---|---|
| 277,628 | 5/1883 | Sullivan . | |
| 358,975 | 3/1887 | Henzel . | |
| 420,834 | 2/1890 | Seib . | |
| 1,072,996 | 9/1913 | Schneider . | |
| 1,501,228 | 7/1924 | Martin . | |
| 1,949,850 | 3/1934 | Willard . | |
| 3,122,388 | 2/1964 | Powers . | |
| 3,183,027 | 5/1965 | Powers . | |
| 3,188,129 | 6/1965 | Broch . | |
| 3,455,591 | 7/1969 | Powers . | |
| 3,543,547 | 12/1970 | Sugiyama . | |
| 3,638,984 | 2/1972 | Davidson . | |
| 3,640,560 | 2/1972 | Zawadzki et al. | 292/341.16 |
| 3,751,086 | 8/1973 | Geringer . | |
| 3,804,442 | 4/1974 | Powers . | |
| 3,819,215 | 6/1974 | Fuss . | |
| 3,861,727 | 1/1975 | Froerup et al. . | |
| 4,211,443 | 7/1980 | Butts et al. . | |
| 4,491,354 | 1/1985 | Williams . | |
| 4,626,010 | 12/1986 | Hanchett, Jr. et al. . | |
| 4,756,566 | 7/1988 | Logas . | |
| 4,917,425 | 4/1990 | Logas . | |
| 4,986,584 | 1/1991 | Logas . | |
| 5,118,150 | 6/1992 | Jarrett . | |
| 5,195,792 | 3/1993 | Stendal | 292/341.16 |

*Primary Examiner*—Rodney M. Lindsey
*Attorney, Agent, or Firm*—William W. Haefliger

[57] ABSTRACT

An electrical release door strike comprising a carrier frame; a strike bolt carried by the frame for movement when released, allowing door opening, the bolt adapted to receive and resist door opening force prior to bolt movement; a solenoid carried by the frame to have either of two alternate positions relative to the frame; and structure operatively connected between the solenoid and bolt in either of the positions to cause the bolt to assume i) a fail safe condition when the solenoid is in one of the positions, ii) a fail secure condition when the solenoid is in the other of the positions.

10 Claims, 7 Drawing Sheets

11a
81
5
6
17
12
10
45
32b
32
33
30a
45a
C
132
45b
D
34
20
36a
18d
32a
20a
19
A
B
2
2
30
36
18
15
46
16
49
37a
11
21a
14
37
21
37b
57
31
13
181
6
5
81
11b

FIG. 7.
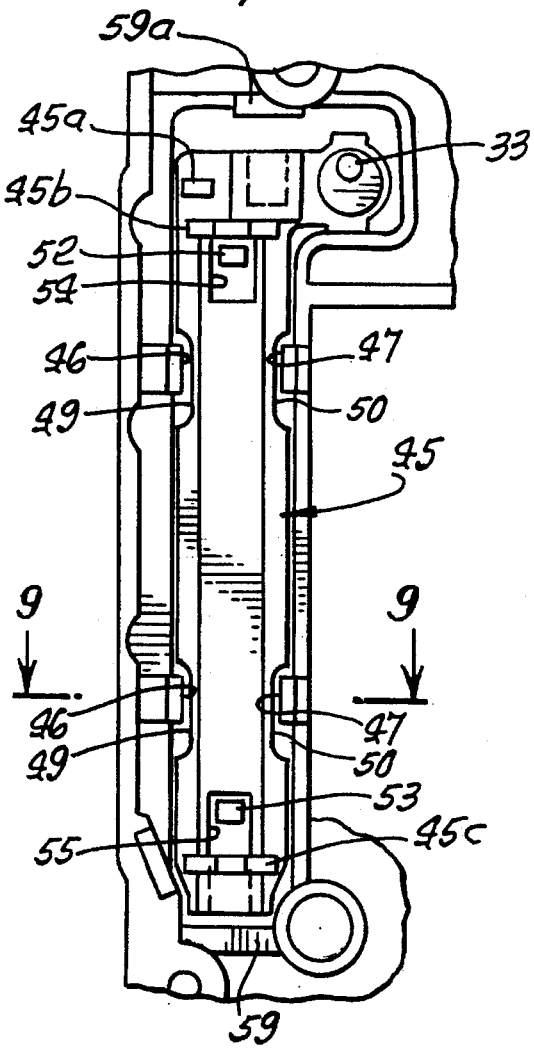
FIG. 8.
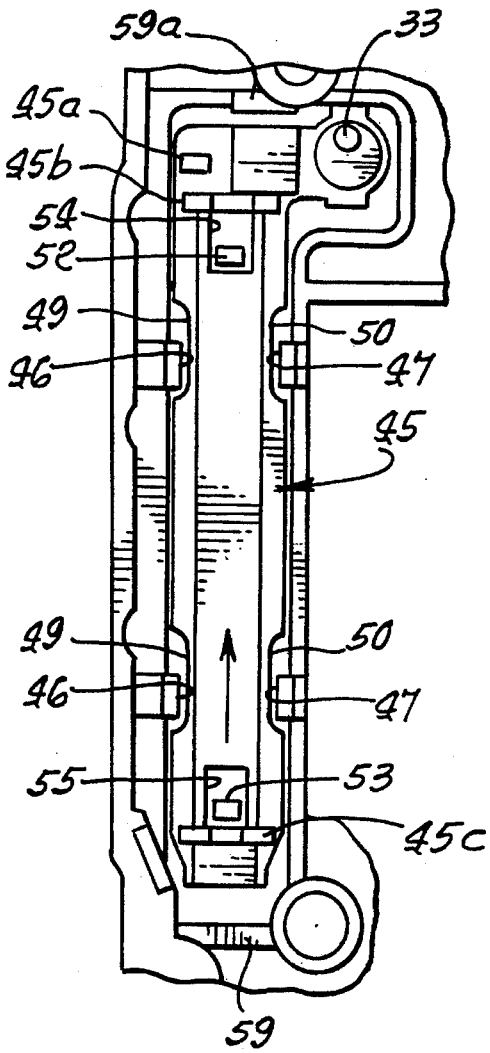
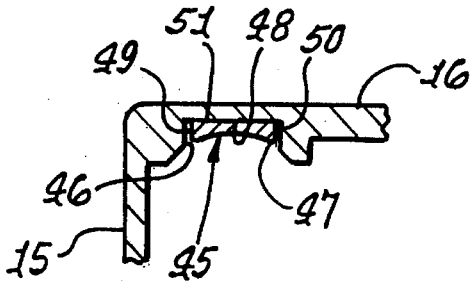
FIG. 9.

FIG. 10.
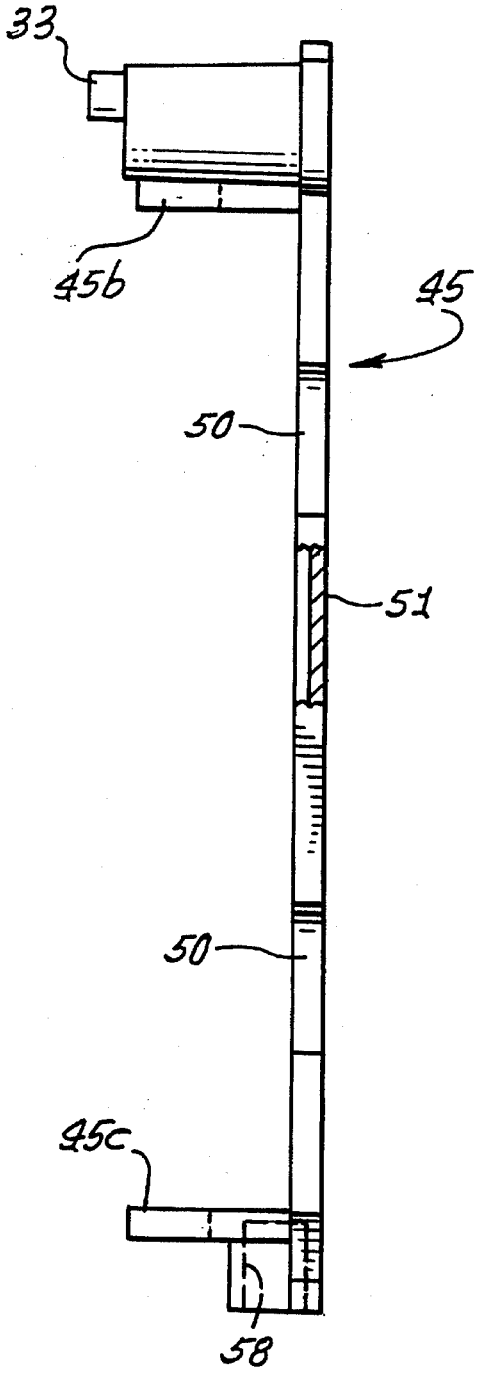
FIG. 11.
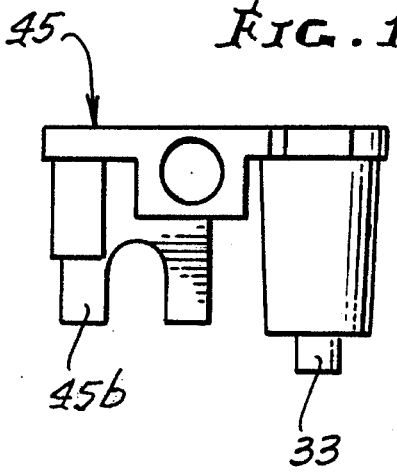
FIG. 12.
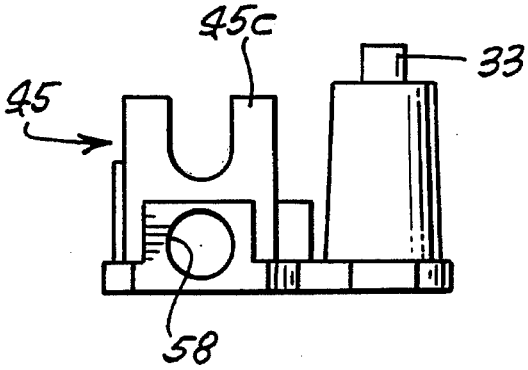
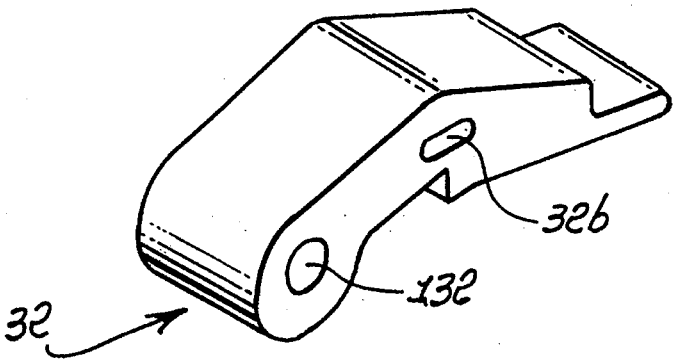
FIG. 13.

132
20
19
21
31
32
32b
33
32a
18
36
45c
13
59a
59
17
45
57
45a
45b
30a
54
52
15
30
36a
34

18
132
30a
14
32
32a
19
30
32b
33
31
45c
36a
59a
36
17
57
59
45a
45
45b
52
54
15
34
37

ELECTRIC STRIKE FOR FAIL SAFE OR FAIL SECURE OPERATION

This is a continuation, of application Ser. No. 08/093,473 filed Jul. 19, 1993 now abandoned.

BACKGROUND OF THE INVENTION

This invention relates generally to compact, electrically energizable door strike apparatus, and more particularly, to an improved mechanism wherein a solenoid is operable to control strike latch mechanism, and wherein a solenoid may have either of two different selected positions. In one position of the solenoid, the mechanism has a fail safe mode, wherein, if power to the solenoid fails, the bolt allows a door to be safely opened; and in the other selected position of the solenoid, the mechanism has a fail secure mode, wherein, if power to the solenoid fails, the bolt secures the door against opening.

There is need for electrically controlled strike bolts of simple, compact construction for securing doors against opening, and also for allowing door opening, in case of power failure. Previously, these two functions required two different strike devices, each device preventing only one of these functions. No way was known, to my knowledge, to embody the two functions in a single mechanism which could be simply adjusted to allow one or the other of such functions to be in effect.

SUMMARY OF THE INVENTION

It is a major object of the invention to provide electrical release, door strike apparatus meeting the above need. Basically, the apparatus embodies:

a) a carrier frame, b) a strike bolt carried by the frame for movement when released, allowing door opening, the bolt adapted to receive and resist door opening force prior to bolt movement, c) a solenoid carried by the frame to have either of two alternate positions relative to he frame, c) and means operatively connected between the solenoid and bolt in either of the positions to cause the bolt to assume i) a fail safe condition when the solenoid is in one of the positions, ii) a fail secure condition when the solenoid is in the other of the positions.

It is another object to provide such means to include a carrier for the solenoid, the carrier movable between a first location when the solenoid is in its one position, and a second location when the solenoid is in the other of its positions. In this regard, a spring is typically employed for urging the carrier in a direction to assure the fail safe or fail secure condition; and guide means on the frame and carrier guides the carrier to move unidirectionally on the carrier, which may operate as a shuttle. The solenoid typically has a plunger and a body, the plunger movable axially to displace the carrier, the plunger extending one direction in the one position of the solenoid, and the plunger extending axially in the opposite direction in the other position of the solenoid.

Yet another object is to provide a secondary arm having a floating fulcrum and shiftable in response to the movement of the carrier, and a primary arm engaging the secondary arm and blocking movement of the bolt, the primary arm being released for unblocking bolt movement in response to shifting of the secondary arm. The solenoid is typically mounted for endwise reversible carriage by the carrier.

These and other objects and advantages of the invention, as well as the details of an illustrative embodiment, will be more fully understood from the following specification and drawings, in which:

DRAWING DESCRIPTION

Figure 1:
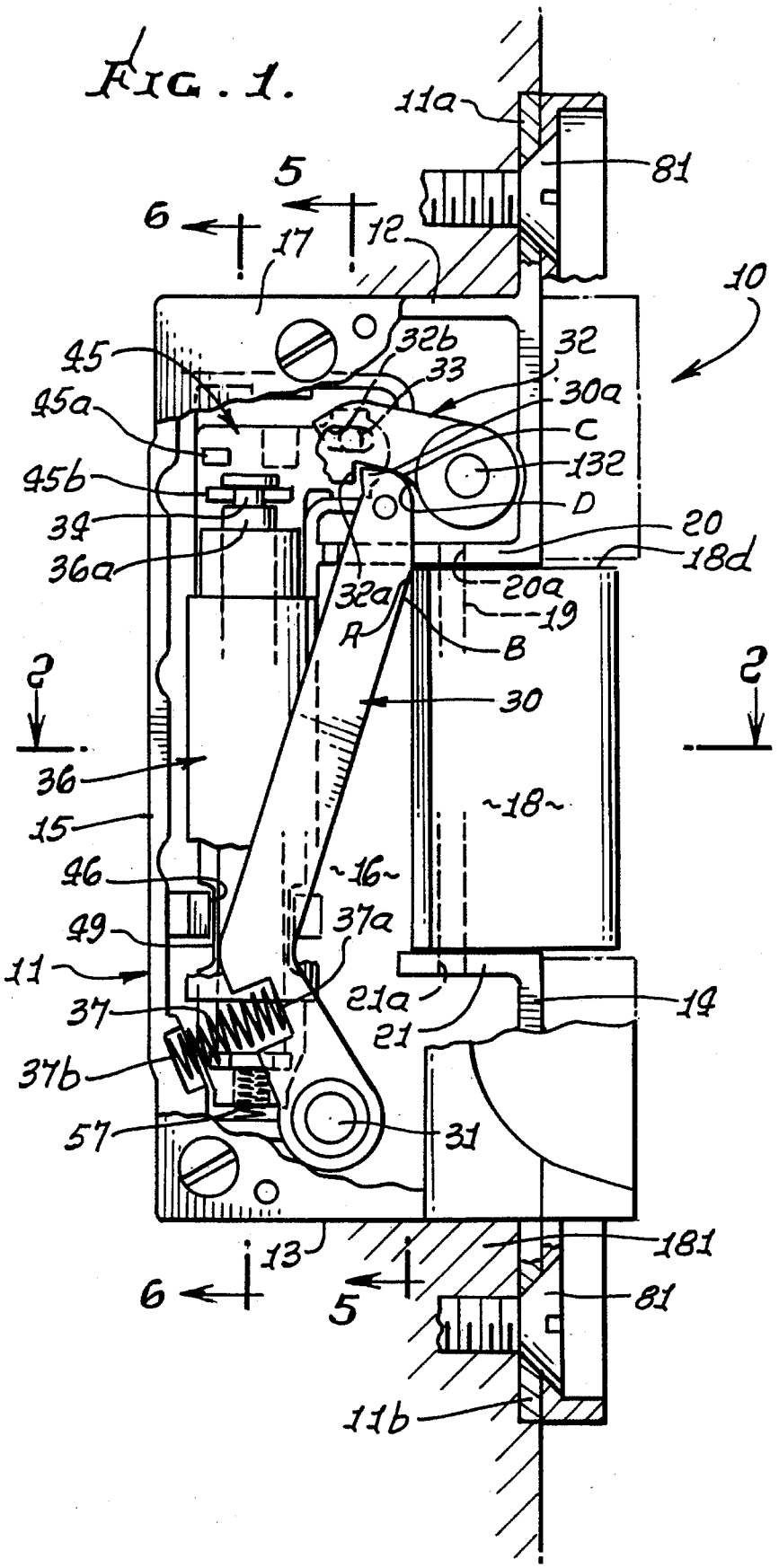
FIG. 1 is a side elevation taken through one form of electrical strike apparatus embodying the invention and shown in blocking position
Figure 2:
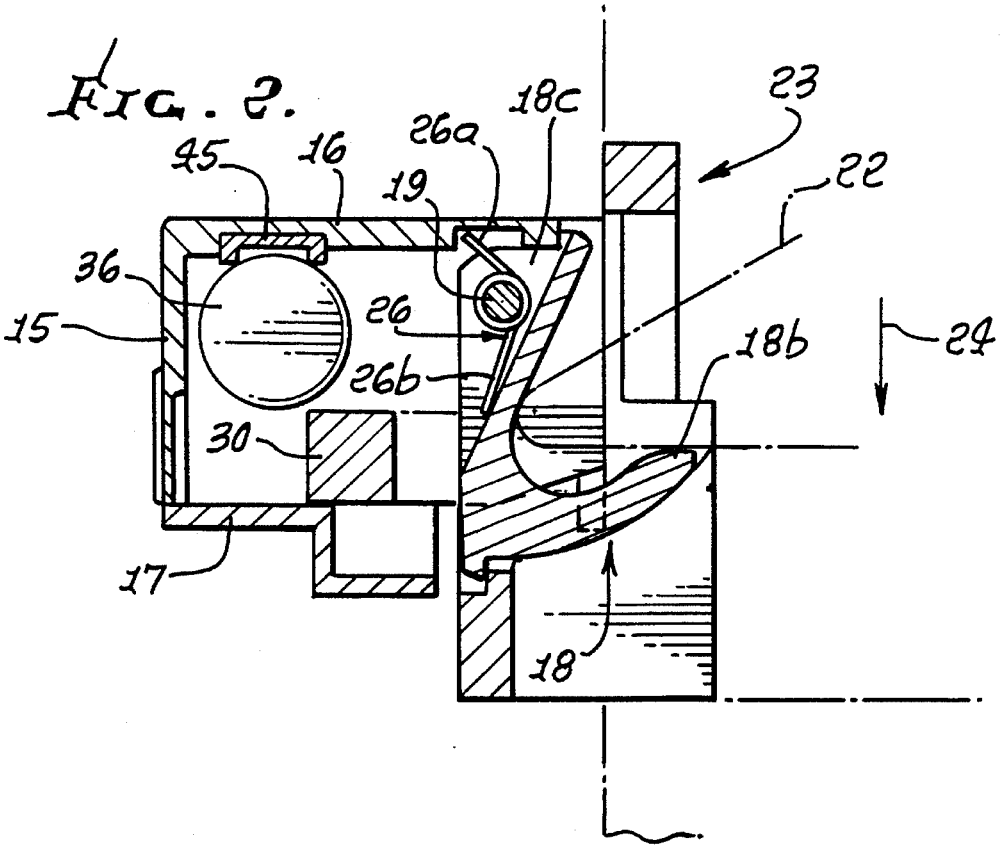
FIG. 2 is a horizontal section taken on lines 2—2 of FIG. 1.
Figure 3:
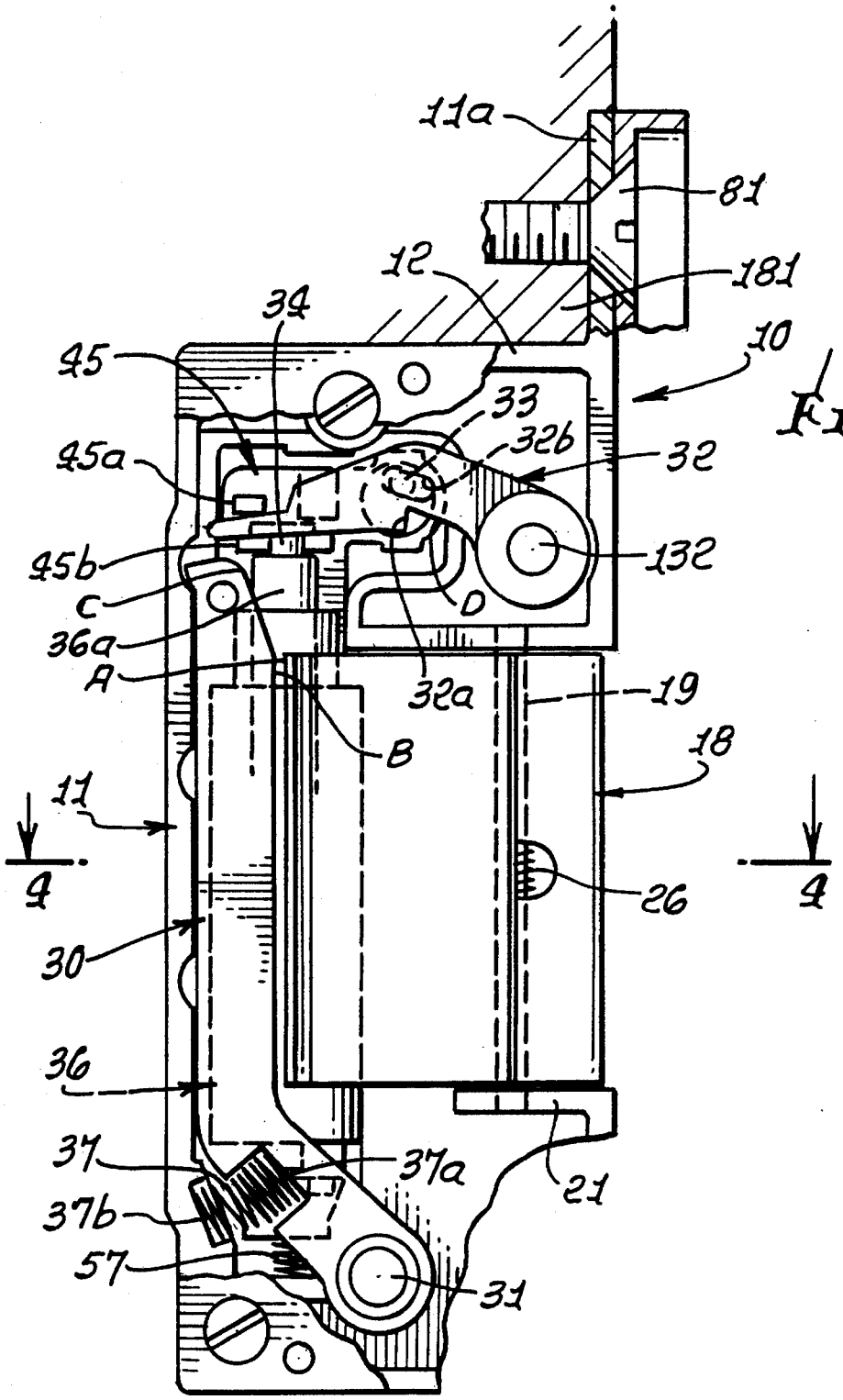
FIG. 3 is a view like FIG. 1 showing the apparatus in unblocking position.
Figure 5:
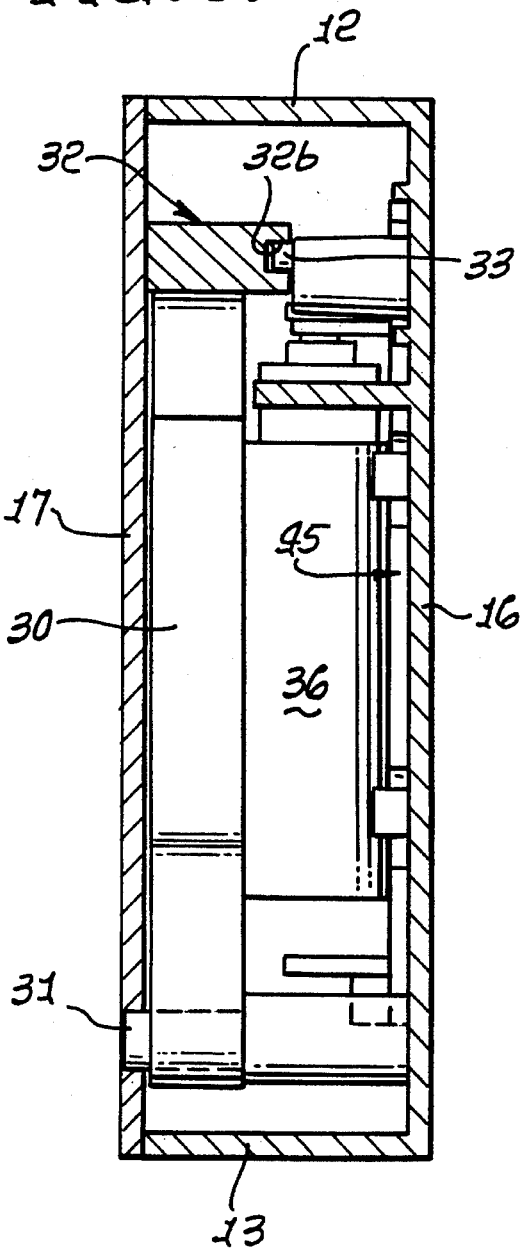
FIG. 5 is a vertical section taken on lines 5—5 of FIG. 1.
Figure 15:
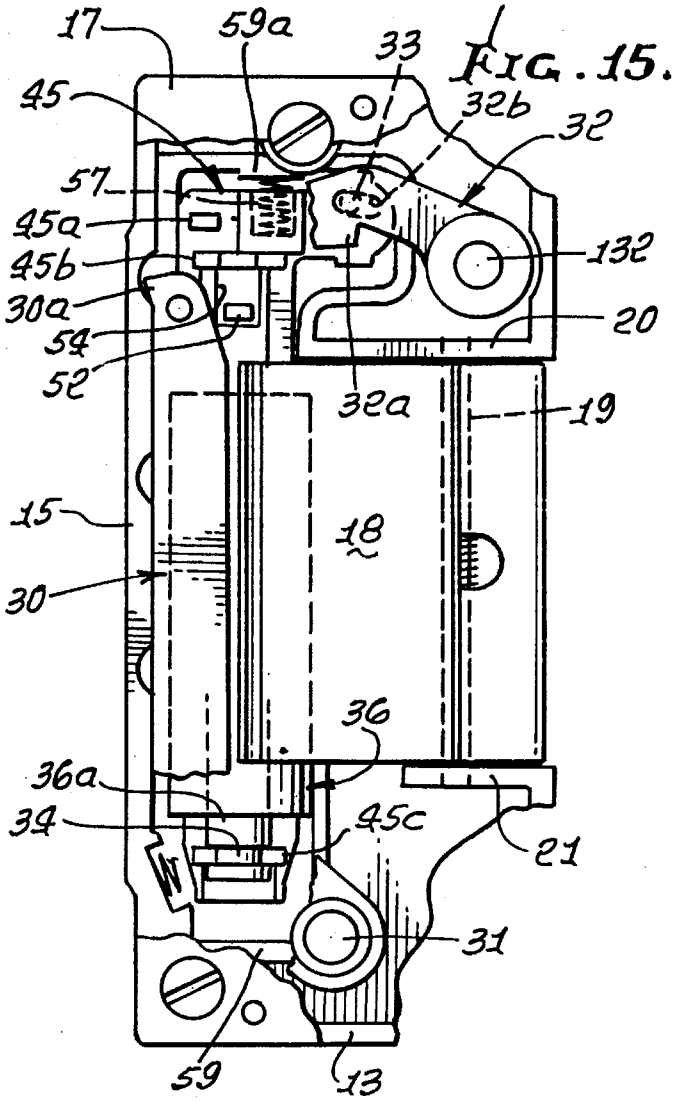
Figure 14:
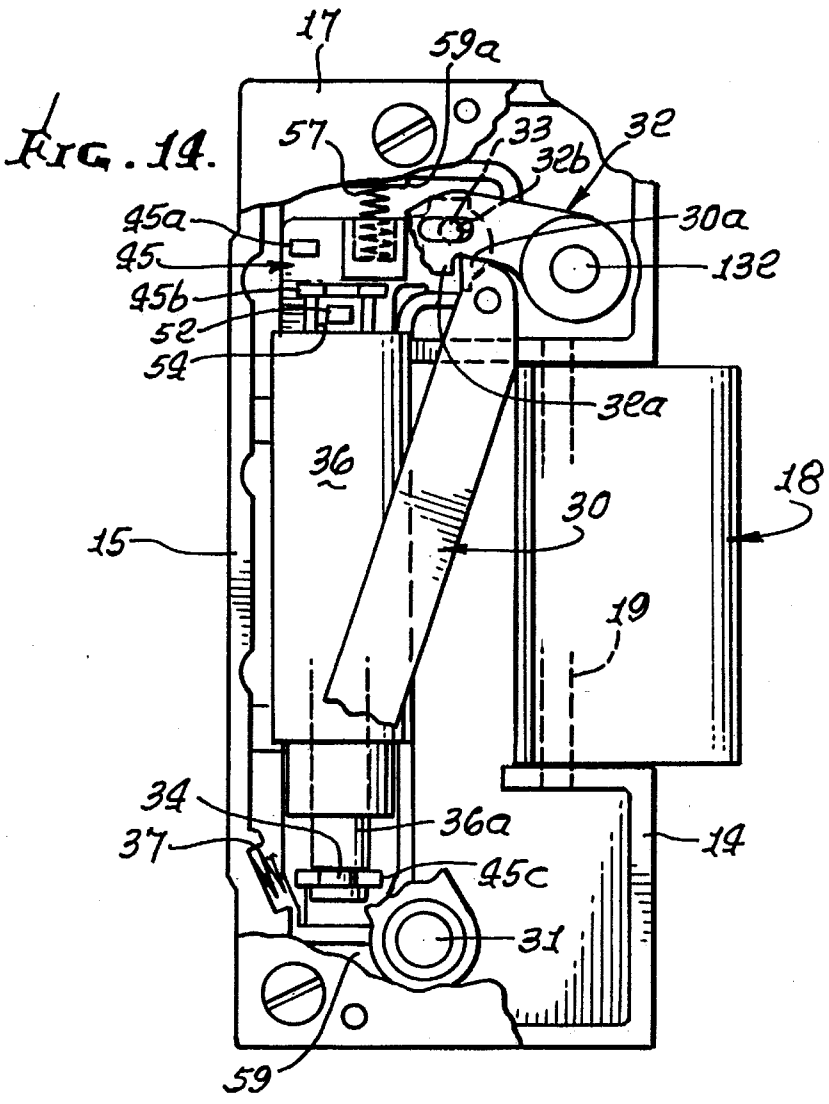

FIG. 7 a fragmentary view of shuttle structure, as employed in the FIG. 1–3 apparatus, with the shuttle on one extreme position, as also viewed in FIG. 1;

FIG. 8 is a view like FIG. 7 showing the shuttle in another extreme position, as also viewed in FIG. 3;

FIG. 9 is a horizontal section taken on lines 9—9 of FIG. 7;

FIG. 10 is an elevation showing the shuttle in side view;

FIG. 11 is a top plan view of the FIG. 10 shuttle;

FIG. 12 is a bottom plan view of the FIG. 10 shuttle;

FIG. 13 is a perspective view of latch structure as also viewed in side elevation in FIGS. 1 and 3;

FIG. 14 is a view like FIG. 1 but employing an upper spring to urge the shuttle downwardly, the to solenoid shown as being endwise reversed and shown in fail safe (power off) down position corresponding to blocking position of the bolt; and FIG. 15 is a view like FIG. 14 but showing the up position of the shuttle, the spring being compressed, and power being on, the bolt being in unblocking position.

DETAILED DESCRIPTION

Figure 4:
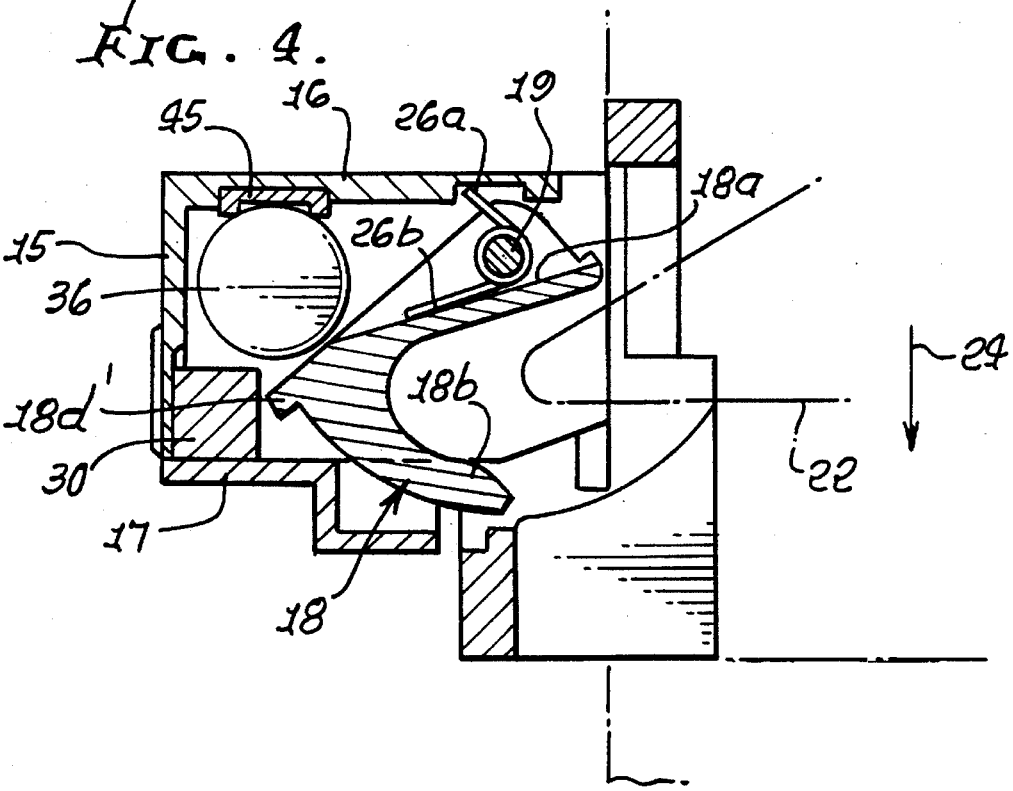
FIG. 4 is a horizontal section taken on lines 4—4 of FIG. 3.

As seen in FIGS. 1–6, the device 10 includes a case and frame 11 having top and bottom walls 12 and 13, front and rear walls 14 and 15, and left and right side walls 16 and 17. The case may have flanges or tabs 11*a* and 11*b* to be attached, as by fasteners 81 and 81' to a door frame 181. A vertically elongated strike bolt 18 is pivotally attached to the case, as by vertically elongated pin 19 received through openings in bolt flange or flanges 18*c*. Opposite ends of the pin are retained in openings 20*a* and 21*a* in case flanges 20 and 21; and the rear side of the bolt is recessed at 18*a* to receive the pin, as seen in FIGS. 2 and 3, whereby the bolt pivots about the vertical axis of the pin, between locking and blocking position, as seen in FIGS. 1 and 2, and unlocked or unblocking condition, as seen in FIGS. 3 and 4.

In locked condition, the hook 18*b* of the bolt overlaps a part 22 in or on a door 23 to prevent swinging of the door in a direction 24. See FIG. 2. In inwardly (clockwise) swung, retracted bolt position, as seen in FIG. 4, the overlap of the hook 18*b* and part 22 is removed, so that the door can then swing in direction 24. A "large" torsion spring 26 is wrapped about pin 19 to yieldably urge the bolt toward locked position, as seen in FIG. 2. One arm 26*a* of the spring 26 bears against the case, and the other arm 26*a* bears against the bolt.

Means, including three arms and a solenoid, are provided within the case to release the strike bolt for pivoting between locked and unlocked positions, as referred to. Such arms are indicated as follows:

1. A first (blocking) arm, as at 30, pivotally connected to the case by pin 31, near the case lower end, and, movable counterclockwise from a first position (see FIG. 1) blocking bolt pivoting to a second position (see FIG. 3) allowing (i.e., unblocking) bolt pivoting to FIG. 3 and 4 position, which in turn allows door opening;
2. a second (release) arm or latch, as at 32, pivotally connected to the case at 132. A pin 33, on a shuttle 45, is received in elongated slot 32*b*, in arm 32 (for providing a floating guilds, to prevent binding of parts). The latch 32 is movable (clockwise for example) from a primary position (see FIG. 3) in which it holds the first arm in its first position, to a secondary position (see FIG. 3) in which the clockwise is placed second arm then allows first arm 30 movement to its second position; (note latch shoulder 32*a* blocking the upper tip 30*a* of arm 30 from counterclockwise swinging in FIG. 1); and
3. a third (trip) arm or plunger, as at 34, movable by stroking of a plunger 36*a* from an initial position (see FIG. 1) in which it holds the second arm 32 in primary position, to a subsequent position (see FIG. 3) in which it effects or allows movement of the second arm to its secondary position, as referred to.

Figure 6:
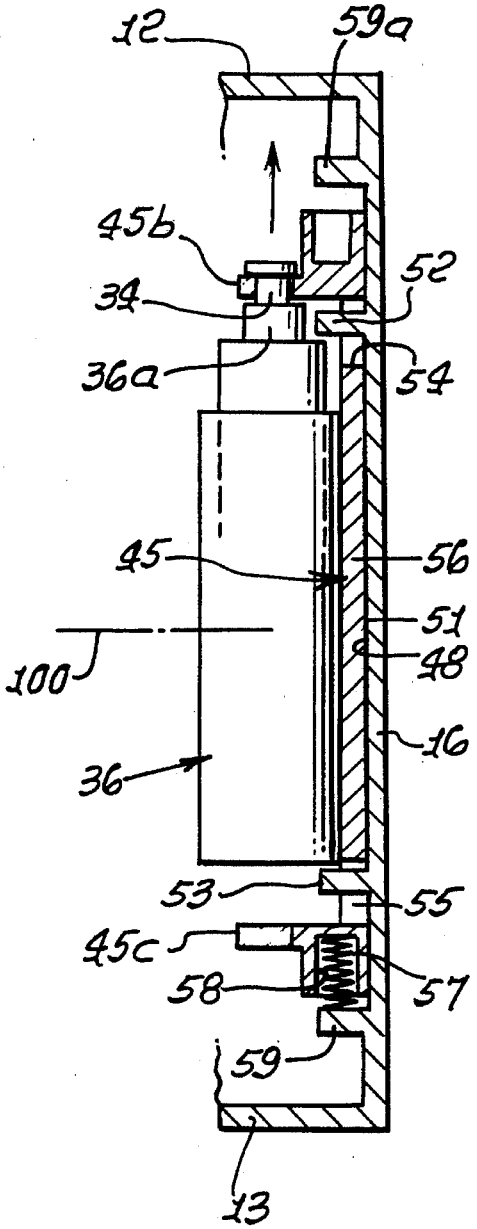
FIG. 6 is a vertical section taken on lines 6—6 of FIG. 1.

Note that axes about which arms 30 and 32 pivot are normal to the plane of FIG. 1, whereas the axis along which arm 34 moves is parallel to the plane of FIG. 1. Also note the following:

i) The bolt and the first arm 30 have interengageable cam surfaces A and B, respectively, in FIG. 1 these surfaces being relatively displaced in FIG. 3 (i.e., as arm 30 pivots clockwise, as in FIG. 4, it allows bolt part 18*d*' to move relatively leftwardly) as the bolt pivots about pin 19.

ii) The first arm 30 and the second arm 32 have interengaged or interfering complementary curved cam surfaces C and D in FIG. 1, these being relatively displaced in FIG. 3. Arm 32 is swung upwardly by solenoid driven arm 34, allowing arm 30 to be pivoted leftwardly, under the influence of bolt cam surface A, as the bolt is moved leftwardly by door part 22; a spring 37, acts to urge arm 30 clockwise to the position seen in FIG. 1. See spring end 37*a* bearing on the arm 30, and end 37*b* bearing on the case.

iii) The second arm 32 and a shuttle 45 associated with the third arm 34 have interfitting elements 32*b* and 45*a* and 45*b* in FIGS. 3 and 6, these elements being relatively displaced in FIG. 3 (i.e., arm 34 is displaced upwardly by plunger 36*a* of solenoid 36 to allow arm 30 to pivot leftwardly, in FIG. 3). Arm 34 is yieldably held downward in FIG. 1 by the solenoid which is activated or energized, to "pull in".

It is clear from the above that the provision of these arms allows a solenoid 36 of lightweight construction to control movement of a heavy-duty bolt, for a door, as for example a building door, the three arms located in very compact relation in a small case 11.

The solenoid is mounted to the shuttle or carrier 45, which is endwise movable in the case between up position (see FIG. 3) and down position (see FIGS. 1 and 6). Note guide surfaces 46–48 on the case, operable to guide surfaces 49–51 on the shuttle. The solenoid body, while mounted on the shuttle, is endwise positioned between case flanges 52 and 53, in FIG. 6, those flanges penetrating through shuttle lost motion openings 54 and 55 in shuttle wall 56. A compression spring 57 captivated in bore 58 in the shuttle bears against case lower flange 59 to urge the shuttle upwardly, when power to the solenoid is OFF, as in FIGS. 3 and 8. This is the fail safe mode, which allows swing to FIG. 4 position. When power is ON, the solenoid pulls the shuttle and latch arm 32 down, as in FIGS. 1, 6 and 7, to hold the arm 30 against counterclockwise rotation, which in turn holds the bolt 18 in FIG. 1 position.

The provision of the shuttle allows selectivity as between the fail safe mode (allowing bolt pivoting and door opening) of FIGS. 1–8, and the fail secure mode of FIG. 14, using the same parts, and enabled by solenoid endwise reversal, as between the fail safe condition or mode location (of FIGS. 1–8), and the fail secure condition or mode (reversed) location (of FIG. 14). The structure seen in FIG. 6 also facilitates this, as it can be seen that, if the solenoid is endwise reversed, plunger 36*a* and arm 34 can interfit element 45*c*. Spring 57 will then bear against case upper flange 59*a*. In that condition, as also seen in FIG. 14, when power is OFF, the shuttle is pushed down by spring 57, which allows pin 33 on 45 to push latch arm 32 counterclockwise preventing release of arm 30, whereby the bolt is held in door-blocking position. This is the "fail secure" mode or condition. Note symmetric locations of flanges 59*a* and 59, and of flanges 52 and 53, in FIG. 6, relative to a plane 100 bisecting the space between 59 and 59*a* and the space between 52 and 53.

When power is ON, the shuttle is displaced upwardly by the solenoid, displacing the arm 32 upwardly or clockwise, to release arm 30 and the bolt, for swinging to unlocked position. See FIG. 15. In this regard, the interfitting of arm 32 with the shuttle is the same as in FIGS. 1 and 3.

Signaling means may also be provided as disclosed in U.S. Pat. No. 5,118,150, such means including an element carried by the bolt and movable relative thereto to signal the presence of a door part adjacent the bolt.

I claim:

1. In an electrical release door strike, the combination comprising:

a ) a carrier frame, b) a strike bolt carried by the frame for movement when released, allowing door opening, the bolt adapted to receive and resist door opening force prior to bolt movement, c) a solenoid carried by the frame to have either of two alternate positions relative to the frame, d) and means operatively connected between the solenoid and the bolt in either of said positions for causing the bolt to assume i) a fail safe condition allowing bolt pivoting when the solenoid is in one of said positions, ii) a fail secure condition preventing bolt pivoting when the solenoid is in the other of said positions.

2. The combination of claim 1 wherein said means includes a carrier supporting the solenoid, the carrier movable between a first location when the solenoid is in said one position, and a second location when the solenoid is in the other of said positions.

3. The combination of claim 2 including a spring associated with the frame and urging the carrier in a direction to assure said fail safe condition.

4. The combination of claim 2 including interengaged guide means on the frame and on the carrier for guiding the carrier to move unidirectionally on the frame.

5. The combination of claim 3 including interengaged guide means on the frame and on the carrier for guiding the carrier to move unidirectionally, and the spring located endwise of the carrier.

6. The combination of claim 2 wherein said means includes a secondary arm having a floating fulcrum and shiftable in response to said movements of the carrier, and a primary arm engaging the secondary arm and blocking movement of the bolt, the primary arm being released for unblocking bolt movement in response to shifting of the secondary arm.

7. The combination of claim 1 wherein the solenoid has a plunger and a body, the plunger extending axially in one direction in said one position of the solenoid, and the plunger extending axially in the opposite direction in said other position of the solenoid.

8. The combination of claim 7 including a carrier supporting the solenoid, the plunger movable axially to displace the carrier.

9. The combination of claim 5 wherein the solenoid has a body and the carrier and the frame have lost motion interfitting elements which interfit in both of said carrier first and second locations, to allow carrier endwise displacement while the solenoid body is blocked against endwise movement relative to the frame.

10. The combination of claim 9 wherein the carrier has a slider body, and said elements include lost motion openings in said body, and flanges on the frame which project through said openings and into endwise captivating relation with the solenoid body.

* * * * *